US007584529B1

(12) United States Patent
Parker

(10) Patent No.: US 7,584,529 B1
(45) Date of Patent: Sep. 8, 2009

(54) CASKET WITH ALCOVE MEMORIALIZATION FEATURE IN VERTICAL PUFFING OF CAP DISH ASSEMBLY

(75) Inventor: Daniel J. Parker, Connersville, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 12/122,439

(22) Filed: May 16, 2008

(51) Int. Cl.
*A61G 17/00* (2006.01)

(52) U.S. Cl. ..... 27/19; 27/2; 27/14

(58) Field of Classification Search ..... 27/19, 27/14, 16, 18, 2; D99/2, 8, 10; 108/25, 26
See application file for complete search history.

(56) References Cited

U.S. PATENT DOCUMENTS 4,457,054 A 7/1984 Craft et al.
5,611,124 A 3/1997 Biondo et al.
6,324,736 B1 * 12/2001 Atrio ..... 27/2
6,715,190 B2 4/2004 Groemminger et al.
7,249,402 B2 * 7/2007 Davis et al. ..... 27/18
7,316,053 B2 * 1/2008 Dennis et al. ..... 27/2

* cited by examiner

*Primary Examiner*—William L. Miller
(74) *Attorney, Agent, or Firm*—Wood, Herron & Evans, LLP

(57) ABSTRACT

A casket comprises a shell, a cap closable on the shell, and a cap dish assembly mounted to an underside of the cap. The dish assembly comprises a cap panel having opposite sides and opposite ends, a puffing member positioned at each of the opposite sides and each of the opposite ends of the cap panel, and an alcove structure formed in one of the puffing members positioned at one of the opposite ends of the cap panel, the alcove structure having a floor, a pair of side walls, and a back wall, and defining an area recessed away from an onlooker in which to display items to memorialize a deceased.

11 Claims, 3 Drawing Sheets

CASKET WITH ALCOVE MEMORIALIZATION FEATURE IN VERTICAL PUFFING OF CAP DISH ASSEMBLY

FIELD

This invention relates generally to caskets, and more particularly to memorialization features for caskets.

BACKGROUND

There is a trend in the death care industry towards "personalization"—the personalizing of funeral products and funeral, memorial or other services purchased for the deceased, to provide a more meaningful experience for the family and friends of the deceased. Oftentimes, there is a desire on the part of the deceased's family and loved ones to memorialize the faithfully departed. This may manifest itself in several ways such as, for example, displaying various religious or sentimental items close to or on the casket during viewing of the deceased or even placing items in the casket prior to interment of the casket above or below ground. The display and/or storage of various items of personalty near or in caskets has existed as a means to memorialize the deceased.

One of the earlier attempts at providing a means of personalizing or customizing a casket to the deceased may be seen with reference to the assignee's U.S. Pat. No. 4,457,054 titled Casket Shelf. This patent discloses a casket shelf which is mounted to the dish assembly of the head end cap when the head end cap is in the open position, such as during viewing of the deceased. The shelf provides a surface for supporting and displaying articles of religious or personal significance to the deceased.

A more recent innovation may be seen with reference to the assignee's U.S. Pat. No. 5,611,124 titled Casket Having Memorabilia Compartment. Caskets embodying one embodiment of the invention of the '124 patent have a drawer built into the foot end lid in which keepsakes of the deceased can be stored and displayed, and are commercially available as the MemorySafe® line of caskets from Batesville®. Until the innovative casket of the '124 patent, caskets did not have any designated, easily accessible receptacle or compartment for either the display of personal effects of the deceased therein or the inclusion therein of mementos of memorialization by the deceased's family and friends. Prior attempts at solving this shortcoming had generally taken the form of the placement of a small memento box into the casket alongside the deceased. However, such memento boxes often appeared as an afterthought, simply placed alongside the deceased in the casket somewhat haphazardly. The '124 patent solved this shortcoming, as it provided the first casket with a memorabilia compartment integral to the casket for displaying and storing mementos and other items of memorabilia.

A further, and even more recent, innovation in the area of casket personalization may be seen with reference to the assignee's U.S. Pat. No. 6,715,190 for Memorialization Casket. This patent discloses an alcove structure formed in the cap panel in the underside of the head end lid, for receiving ornaments or memorabilia when the lid is in the open position during visitation or during a funeral or other memorial service, as a means of memorializing the deceased.

Despite the advancements made in the area of personalization of caskets as demonstrated by the products discussed above, there remains room for improvement.

SUMMARY

In one aspect, a casket comprises a shell, a cap closable on the shell, and a cap dish assembly mounted to an underside of the cap. The dish assembly comprises a cap panel having opposite sides and opposite ends, a puffing member positioned at each of the opposite sides and each of the opposite ends of the cap panel, and an alcove structure formed in one of the puffing members positioned at one of the opposite ends of the cap panel, the alcove structure having a floor, a pair of side walls, and a back wall, and defining an area recessed away from an onlooker in which to display items to memorialize a deceased.

In another aspect, a cap dish assembly is adapted to be mounted to an underside of a cap of a casket. The dish assembly comprises a cap panel having opposite sides and opposite ends, a puffing member positioned at each of the opposite sides and each of the opposite ends of the cap panel, and an alcove structure formed in one of the puffing members positioned at one of the opposite ends of the cap panel, the alcove structure having a floor, a pair of side walls, and a back wall, and defining an area recessed away from an onlooker in which to display items to memorialize a deceased.

The said alcove structure can include a shelf, formed as a part of the floor, which projects toward an onlooker. The casket can further include a support beneath the floor and attached to the one puffing member for supporting the floor. The cap can be a pair of caps, a head end cap and a foot end cap, with the dish assembly being mounted to the head end cap. The puffing member in which the alcove is formed can be oriented generally vertically when the cap is in an open position. The one puffing member can have an opening in which the alcove structure is mounted; the opening can have straight sides, a straight lower end, and an arcuate upper end. The alcove structure can include a shelf, formed as a part of the floor, which projects toward an onlooker, the shelf being supported at least in part by the straight lower end of the opening in the one puffing member.

DRAWINGS

DESCRIPTION

Figure 1:
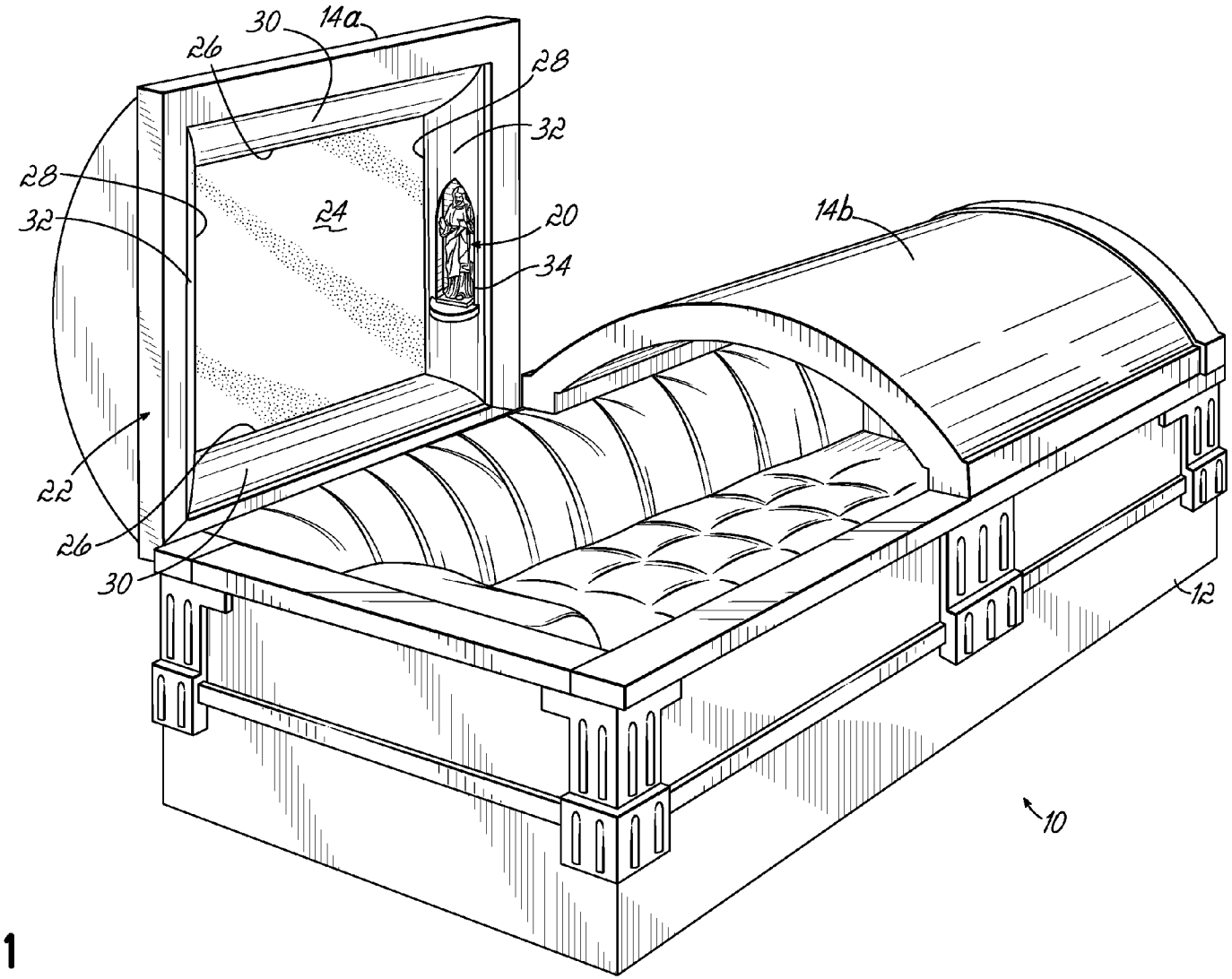
FIG. 1 is a perspective view of a casket with memorialization feature according to the disclosure herein.

Referring first to FIG. 1, a casket 10 has a shell 12, and at least one cap or lid. As illustrated, casket 10 has a pair of caps, a head end cap 14*a* and a foot end cap 14*b*. The memorialization feature of this disclosure can be incorporated into the head end cap 14*a* or the foot end cap 14*b* or both of the illustrated split top casket, or into the single cap of a full couch casket.

Figure 2:
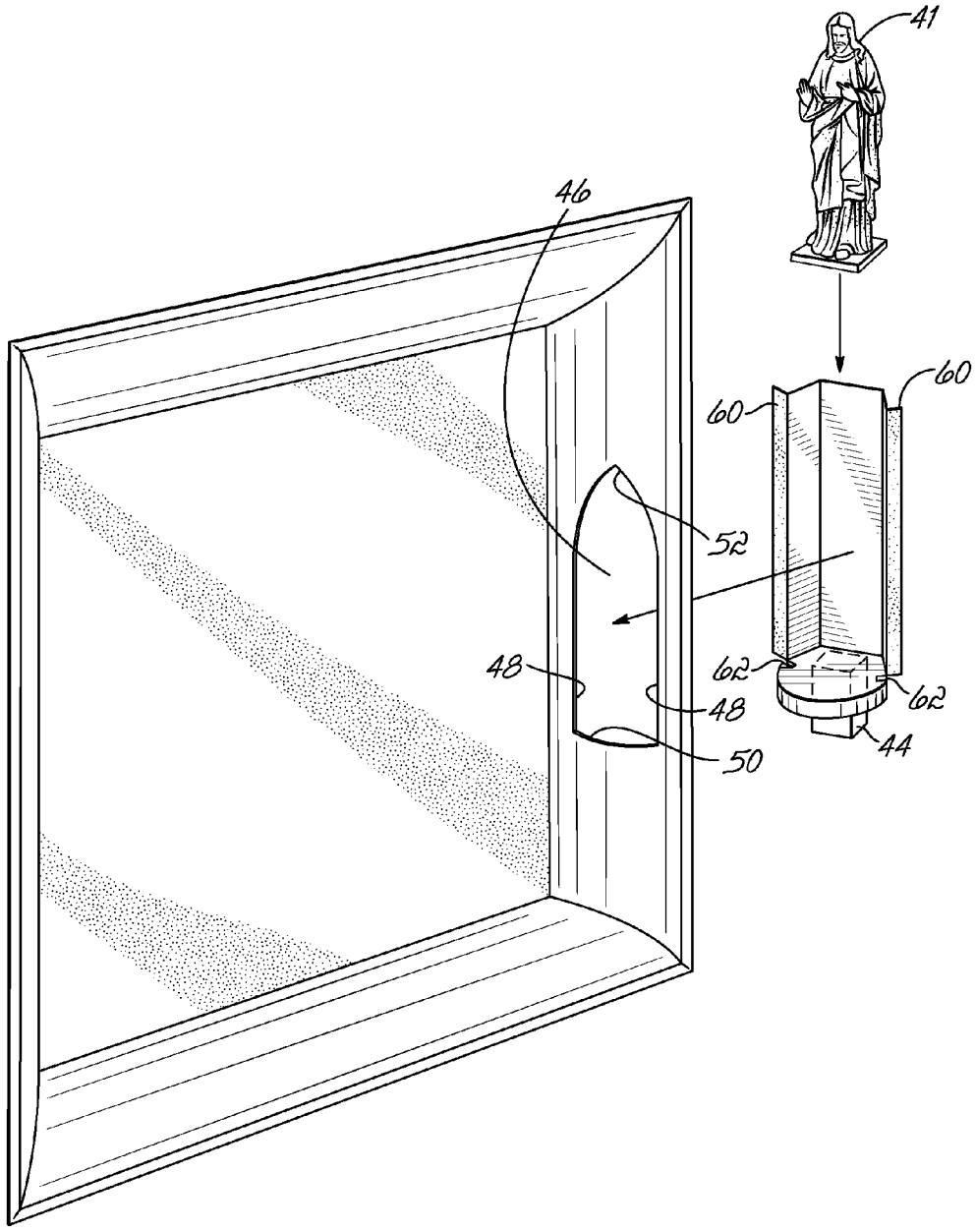
FIG. 2 is an enlarged exploded perspective view of the memorialization feature of FIG. 1.
Figure 3:
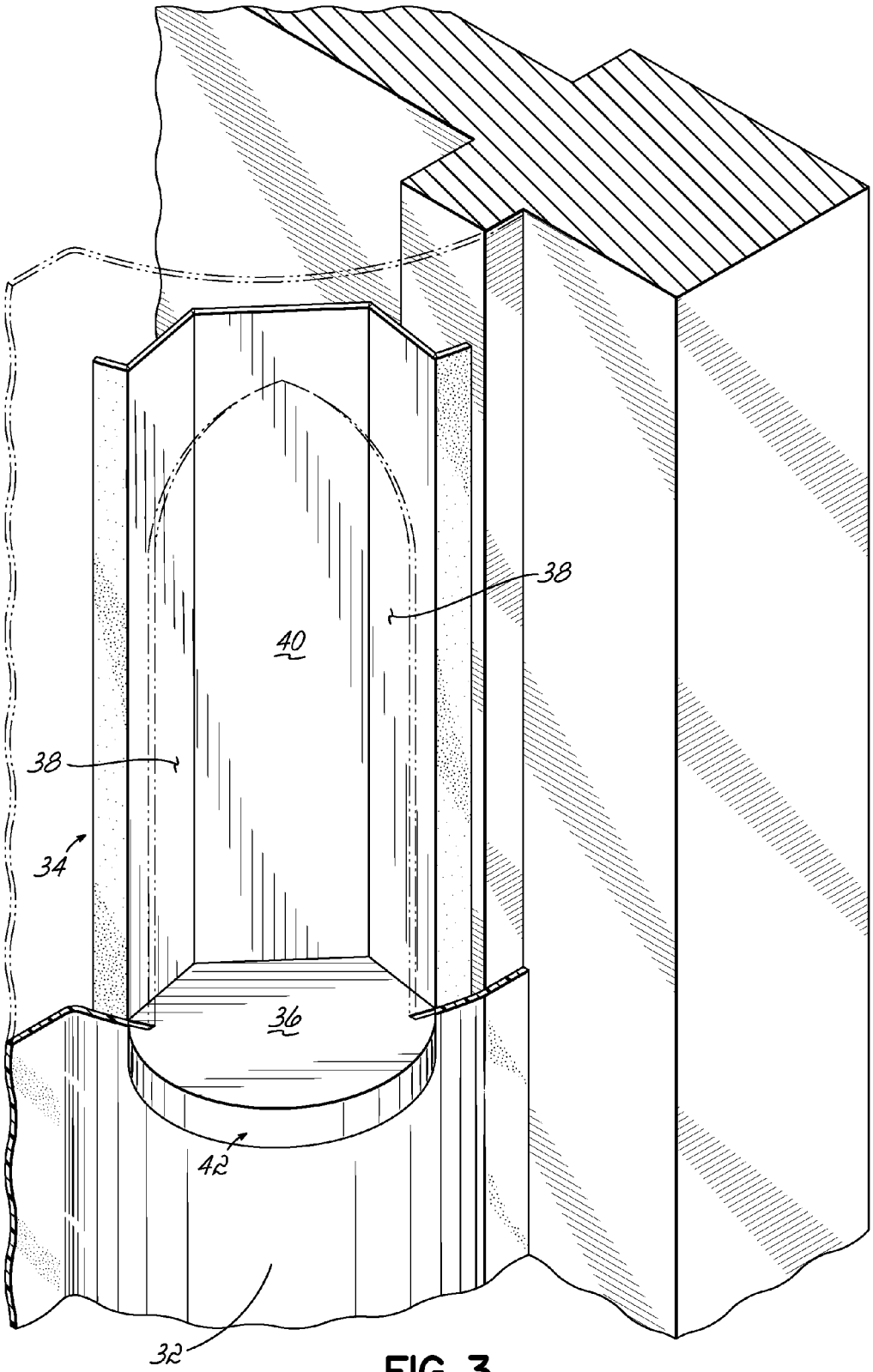
FIG. 3 is a view similar to FIG. 2, enlarged even more, of the assembled memorialization feature of FIG. 1.

As illustrated, and referring now to all FIGS. 1-3, the memorialization feature 20 is incorporated into the head end cap 14*a*. More particularly, the head end cap 14*a* has a dish assembly 22 mounted to an underside thereof. The dish assembly 22 comprises a cap panel 24 having opposite sides 26, 26 and opposite ends 28, 28, a puffing member 30 positioned at each of the opposite sides 26 and a puffing member 32 positioned at each of the opposite ends 28 of the cap panel, and an alcove structure 34 formed in one of the puffing members 32 positioned at one of the opposite ends 28 of the cap panel 24. The alcove structure 34 has a floor 36, a pair of side walls 38, 38, and a back wall 40, and defines an area recessed away from an onlooker in which to display items to memorialize a deceased, such as ornament 41.

More particularly, alcove structure 34 can include a shelf 42, formed as a part of the floor 36 of the alcove structure 34, which projects toward an onlooker, i.e. away from puffing member 32. A support 44 (FIG. 2) can be positioned beneath the floor 36 of the alcove structure 34 and attached to the puffing member 32 for supporting the floor 36 and hence alcove structure 34. Support 44 can be, for example, a small block of wood or plastic, attached to the rear side of the puffing 32 with double sided tape (not shown) or any other suitable fastener; floor 36 would simply rest atop an upper surface of the block. As illustrated, the puffing member 32 in which said alcove 34 is formed is oriented generally vertically when the cap 14*a* is in an open position. The puffing member 32 can have an opening 46 in which to mount the alcove structure 34. The opening 46 can have, for example, straight sides 48, 48, a straight lower end 50, and an arcuate upper end 52. The shelf 42 can be supported at least in part by the straight lower end 50 of the opening 46 in the puffing member 32.

Each of the side walls 38 can include a flange 60 extending laterally outwardly therefrom to facilitate attaching the alcove structure 34 to the puffing member 32. Each flange 60 can be attached by double sided tape, adhesives, or any other suitable attachment device. A notch 62 on either lateral side of the floor 36 of the alcove structure 34 can receive a respective side 48 of the opening 46 to further secure the alcove structure 34 in place. The alcove structure 34 can be rotated 180° to conceal the floor or shelf 36 and ornament 41 if desired.

The cap panel 24, puffing members 320, 32, and alcove structure 34 can be fabricated of a type of sheet material known as chip board, single cell cardboard, or any other suitable material, and can be covered with decorative fabric for appearance.

The embodiments shown and described are for illustrative purposes only. The drawings and the description are not intended to limit in any way the scope of the claims. Those skilled in the art will appreciate various changes, modifications, and alternative embodiments. All such changes, modifications and embodiments are deemed to be embraced by the claims. Accordingly, the scope of the right to exclude shall be limited only by the following claims and their equivalents.

What is claimed is:

1. A casket comprising:

a shell, a cap closable on said shell, and a cap dish assembly mounted to an underside of said cap, said dish assembly comprising:

a cap panel having opposite sides and opposite ends, a puffing member positioned at each of said opposite sides and each of said opposite ends of said cap panel, and an alcove structure formed in one of said puffing members positioned at one of said opposite ends of said cap panel, said alcove structure having a floor, a pair of side walls, and a back wall, and defining a recessed area in which to display items to memorialize a deceased, said alcove structure oriented such that said floor is generally transverse to a longitudinal extent of said one puffing member, and wherein said alcove structure includes a shelf formed as part of said floor, said shelf extending from said back wall to beyond a front face of said one puffing member.

2. The casket of claim 1 further including a support beneath said floor and attached to said one puffing member for supporting said floor.

3. The casket of claim 1, said cap being a pair of caps, a head end cap and a foot end cap, said dish assembly being mounted to said head end cap.

4. The casket of claim 1 wherein said one puffing member in which said alcove is formed is oriented generally vertically when said cap is in an open position.

5. The casket of claim 1 wherein said one puffing member has an opening in which said alcove structure is mounted, said opening having straight sides, a straight lower end, and an arcuate upper end.

6. The casket of claim 5 wherein said shelf being supported at least in part by said straight lower end of said opening in said one puffing member.

7. A cap dish assembly adapted to be mounted to an underside of a cap of a casket, said dish assembly comprising:

a cap panel having opposite sides and opposite ends, a puffing member positioned at each of said opposite sides and each of said opposite ends of said cap panel, and an alcove structure formed in one of said puffing members positioned at one of said opposite ends of said cap panel, said alcove structure having a floor, a pair of side walls, and a back wall, and defining a recessed area in which to display items to memorialize a deceased, said alcove structure oriented such that said floor is generally transverse to a longitudinal extent of said one puffing member, and wherein said alcove structure includes a shelf formed as part of said floor, said shelf extending from said back wall to beyond a front face of said one puffing member.

8. The dish assembly of claim 7 further including a support beneath said floor and attached to said one puffing member for supporting said floor.

9. The dish assembly of claim 7 wherein said one puffing member in which said alcove is formed is oriented generally vertically when the cap is in an open position.

10. The dish assembly of claim 7 wherein said one puffing member has an opening in which said alcove structure is mounted, said opening having straight sides, a straight lower end, and an arcuate upper end.

11. The dish assembly of claim 10 wherein said shelf being supported at least in part by said straight lower end of said opening in said one puffing member.

* * * * *